US006085657A

United States Patent [19]

Rombult et al.

[11] Patent Number: 6,085,657

[45] Date of Patent: Jul. 11, 2000

[54] REDIRECTING PRINTING MEDIA IN A PREPRESS PRINTING ENVIRONMENT

[75] Inventors: Philip A. Rombult, Bradford; David L. Cooper, Tewksbury, both of Mass.

[73] Assignee: Agfa Corporation, Wilmington, Mass.

[21] Appl. No.: 09/130,280

[22] Filed: Aug. 6, 1998

[51] Int. Cl.[7] ..... B41M 5/00

[52] U.S. Cl. ..... 101/471; 400/633; 101/477; 271/221

[58] Field of Search ..... 101/232, 231, 101/230, 477, 463.1, 471; 400/631, 633; 271/245, 246, 248, 221, 222

[56] References Cited

U.S. PATENT DOCUMENTS

| | | | |
|---|---|---|---|
| 4,621,861 | 11/1986 | Sanchez | 400/633 |
| 5,153,736 | 10/1992 | Stemmle | 400/631 |
| 5,549,864 | 8/1996 | Green et al. . | |
| 5,580,588 | 12/1996 | Greene et al. . | |
| 5,655,452 | 8/1997 | Blake et al. . | |
| 5,738,014 | 4/1998 | Rombult et al. | 101/477 |
| 5,785,441 | 7/1998 | Kobayashi et al. | 406/633 |
| 5,887,525 | 3/1999 | Okamura et al. | 101/463.1 |
| 5,927,702 | 7/1999 | Ishii | 400/633 |
| 5,964,156 | 10/1999 | Smith et al. | 101/471 |

FOREIGN PATENT DOCUMENTS

| | | | |
|---|---|---|---|
| 0847853A1 | 6/1998 | European Pat. Off. | 101/463.1 |

OTHER PUBLICATIONS

U.S. application No. 08/915,844, Jakul et al., filed Aug. 21, 1997.

*Primary Examiner*—Eugene Eickholt
*Attorney, Agent, or Firm*—Robert A. Sabourin

[57] ABSTRACT

An imagesetting or platesetting system and method for transporting one or more sheets of media having varying stiffness and thickness includes the steps of: transporting the sheets through the system in a first direction (A); recording an image onto the sheets; and redirecting one or more of the sheets in a transverse direction (B) relative to the first direction (A). Preferably, this is accomplished using: a transport mechanism for transporting the sheets of media through the system in the first direction (A); an imager for recording the image onto the sheets; and a jogging mechanism for redirecting the sheets in the transverse direction (B). The jogging mechanism can be integrated or modular to the system. Moreover, the jogging mechanism can be used in both internal and external drum imagers.

9 Claims, 4 Drawing Sheets

REDIRECTING PRINTING MEDIA IN A PREPRESS PRINTING ENVIRONMENT

The present invention relates to imaging systems such as platesetters and imagesetters used in a prepress printing environment and, more particularly, to prepress imaging systems having automatic loading and unloading capabilities.

BACKGROUND OF THE INVENTION

Modern imagers, such as imagesetters and platesetters, utilize optical scanners to write or record images for subsequent reproduction or to read a prerecorded image at a pre-defined resolution rate. Such scanners may write or record images on, or read prerecorded images from various media including photo or thermal sensitive paper or polymer films, photo or thermal sensitive coatings or erasable imaging materials, an aluminum or other base printing plate, or other type of media. The media is typically mounted on an imaging support surface which may be planar or curved and then scanned with an optical beam. The primary components of modern imagesetting and platesetting systems include an image processor, which may be in the form of a personal computer or workstation, to generate and/or edit an image, and a raster image processor (RIP) for converting data signals from the image processor into signals which can be understood by an engine or system controller which controls the scanning of the optical beam on the media. The imagesetter or platesetter typically includes a writing engine having a scan assembly. The scan assembly may, for example, be disposed and moveable within a drum cylinder in which the media is mounted for recording. The writing engine controller, in accordance with the signals from the RIP and its own programmed instructions, generates signals to control the optical scanning so as to write images on, or read images from, the media mounted within the drum cylinder by scanning one or more optical beams over the recording media mounted against either the inner or outer circumference of the drum cylinder while the cylinder itself remains fixed. A typical scan assembly of a cylindrical drum type imager system may include a spin mirror or other optical device to direct the light beam over the curved surface of the medium adjacent to the drum cylinder. Modern imaging systems also typically include a loading device, often referred to as an applicator, for loading media onto, and removing media from, the media support surface such as the drum cylinder.

Imaging systems may also include other components such as a media storage device for storing the unrecorded media to be imaged by the imager. The system also often includes a media processor which develops or otherwise processes the recorded image. The imaging system may also include media transport devices, typically electromechanical assemblies, for example to deliver the unrecorded media from the storage device to the imager, or to deliver the recorded media from the imager to the media processor.

SUMMARY OF THE INVENTION

A need has arisen to redirect or "jog" the media in a transverse direction relative to a primary media flow path through the imagesetter or platesetter. This may be required because the media may be registered within the drum cylinder on one end while the media processor accepts the media in a different location, for instance, near the center of the drum cylinder. Therefore, the media must be shifted toward the center of the drum after imaging in order to facilitate entry into the media processor, or any other receiving device.

A need has also arisen to redirect the media through the imagesetter or platesetter without rapid and excessive bending of the media through curves in the transport path, for example, from the drum cylinder to the media processor, especially when the media comprises aluminum printing plates or the like. Using a series of nip rollers and platens to redirect the media along the transport path may scratch and damage the emulsion side of the media. Additionally, the use of numerous nip rollers is costly, especially around curves in the media transport mechanism.

To overcome the above and other shortcomings of the prior art, an imagesetting or platesetting system and method for transporting media includes the steps of: transporting one or more sheets of media through the system in a first direction (A); recording an image onto the sheets; and redirecting the sheets in a transverse direction (B) relative to the first direction (A). Preferably, this is accomplished using: a transport mechanism for transporting the sheets through the system in the first direction (A); an imager for recording the image onto the sheets; and a jogging mechanism for redirecting one or more of the sheets in the transverse direction (B). The jogging mechanism can be integrated or modular to the system. Moreover, the jogging mechanism can be used in both internal and external drum imagers.

It is an object of the present invention to provide an imaging system capable of shifting the media in a transverse direction relative to a primary media transport direction.

It is another object of the present invention to provide a redirecting mechanism in an imaging system which transports the media through the imaging system without excessive bending of the media.

It is yet another object of the present invention to provide a redirecting mechanism including a tensioning device for handling media of various thickness and stiffness.

It is still another object of the present invention to provide a redirecting mechanism in an imaging system, including a tensioning device, which transports the media through the imaging system without damaging an emulsion side of the media.

Additional objects and advantages of the present invention will become apparent to those skilled in the art from the following detailed description, drawings and claims. While the invention is described below with reference to preferred embodiments, it should be understood that the invention is not limited thereto. Those of ordinary skill in the art having access to the teachings herein will recognize additional implementations, modifications, and embodiments, as well as other fields of use, which are within the scope of the invention as disclosed and claimed herein and with respect to which the invention could be of significant utility.

BRIEF DESCRIPTION OF THE DRAWINGS

The aforementioned aspects and other features of the invention are described in detail in conjunction with the accompanying drawings in which the same reference numerals are used throughout for denoting corresponding elements. The drawings are not drawn to scale, but are provided as visual aids for understanding the invention.

DETAILED DESCRIPTION OF THE PREFERRED EMBODIMENTS

Figure 1:
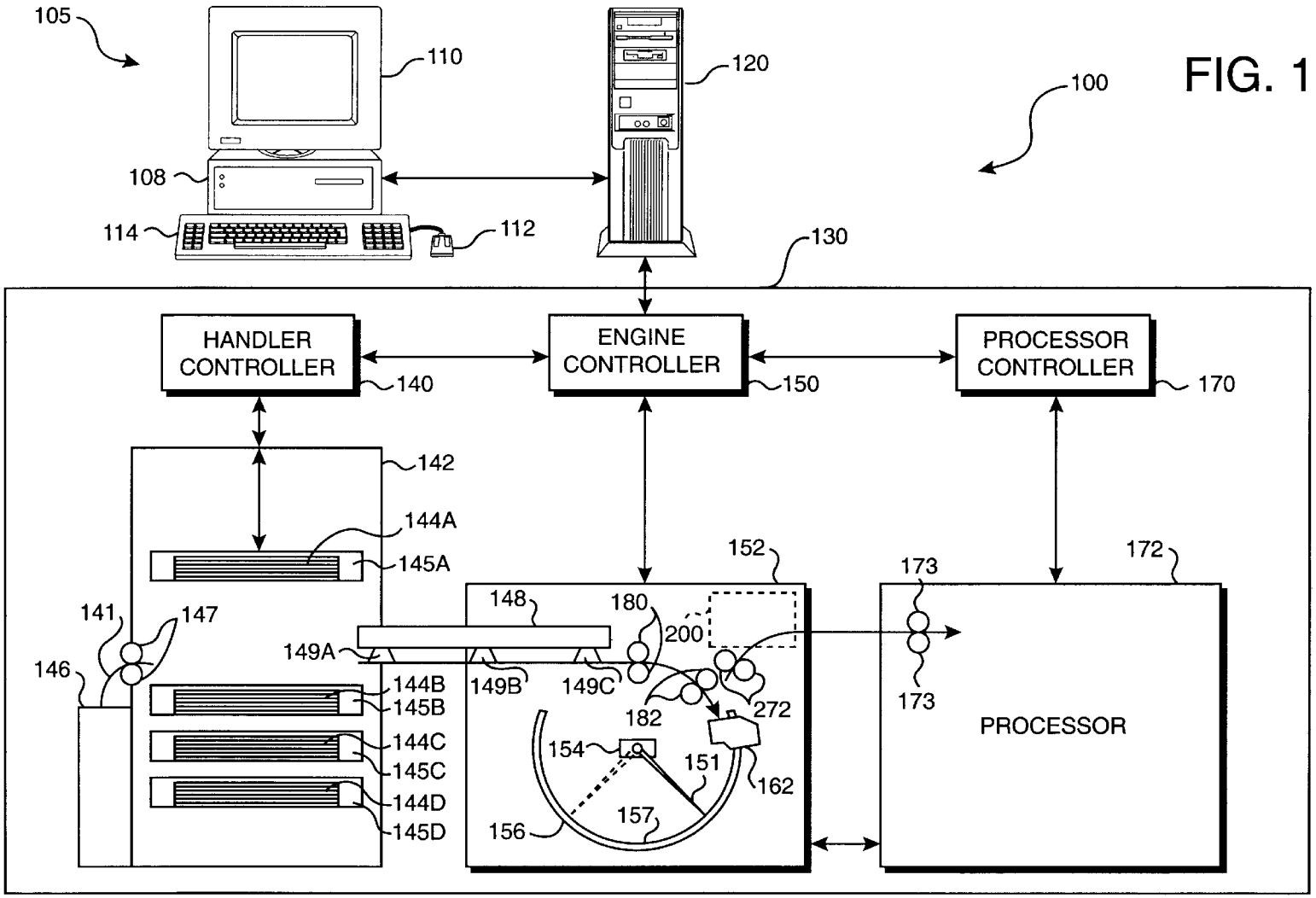
FIG. 1 is a schematic diagram of one embodiment of an imaging system which includes the features of the present invention.

FIG. 1 is a schematic diagram of one embodiment of an internal drum imaging system 100 which includes the features of the present invention. The principles of the invention are also applicable to an external drum imaging system. The imaging system 100 includes a computer system 105, a raster image processor (RIP) 120 and an imagesetter or platesetter 130. The computer system 105, which may be virtually any type of a computing device, allows images to be created or edited and serves as a general operator input device for the imaging system 100. For example, the computer system 105 can be utilized to select a particular scanning resolution and particular size media to be used during a particular operational sequence. The computer system 105 includes a central processing unit or microprocessor 108, and memory and mass storage devices such as disk and/or tape storage elements (not separately shown) which perform processing and storage operations in connection with installed software. The computer system 105 will generally process programs which facilitate the operation of the system 100. The computer system 105 includes input/output peripheral devices such as a keyboard 114, a mouse 112 and a monitor 110. Although the computer system 105 is shown to include particular components, other functionally similar components could be used if desired.

The platesetter or imagesetter 130 has three major components: an on-line stacked media storage device or media handler 142; an imaging engine, imager or imagesetter 152; and an on-line media processor/stacker 172. The media handler 142 and media processor 172 are optional components, i.e. media feeding and media removal could be manually performed if desired.

Additionally, a transport mechanism or means for transporting a film or plate throughout the imagesetter or platesetter 130 is necessary for proper operation. In one preferred embodiment, the transport mechanism includes components of: the media handler 142 which positions the media for entry into the media picker 148; the media picker 148 which picks the media up from the selected cassette 145A, 145B, 145C, 145D; the imager 152 which moves the media into and out of the imaging drum 156; the jogging or redirecting mechanism 200 which jogs or redirects the media in a direction transverse to the primary direction of flow through the transport mechanism in order to properly position the media for entry into the processor 172; and rollers 173 or the like for feeding the media into the media processor 172.

The media handler 142, which is controlled by a handler controller 140, stores media 144A–144D of various sizes, or stacks of various sizes, in respective cassettes 145A–145D. The media could be printing plates or film. The media handler 142 may also include a slip sheet removal mechanism 146 which is preferably of the type described in FIG. 6 and the accompanying text of U.S. Pat. No. 5,655,452 herein incorporated by reference in its entirety to provide supplemental background information. The slip sheet removal mechanism 146 is used to remove, through the rollers 147, a slip sheet 141 which is located between the individual sheets of media stored in the cassette. The slip sheet is placed between each sheet of media to protect the media from being scratched. The cassettes 145A–145D are movable vertically to position a desired cassette below the media delivery device or media picker 148, to provide media picker 148 with access to media of the selected size. The media picker 148 then conveys an individual sheet of the media through rollers 180 and 182 to a loading device or applicator 162 for loading onto the internal support surface 157 of a cylindrical drum 156.

Using an input/output device, such as the keyboard 114 or mouse 112, the system operator can select one of multiple media sizes displayed on the monitor 110 of the computer system 105 so that the appropriate cassette 145A–145D will be moved into alignment with the media picker 148. Selection of the media size according to the image size may also be an automated feature of the computer system 105, the RIP 120, or the imaging system 100. The identification or selection of the desired media size on the computer system 105 results in generation and transmission of a signal by the microprocessor 108 to the RIP 120, which signal is then transformed into an appropriate signal passed on to the handler controller 140. In accordance with this signal, the controller 140 controls the media handler 142 in the manner previously described such that the desired media can be accessed and conveyed by the media picker 142 to the applicator 162 of the imaging engine 152.

In one embodiment, the media picker 148 removes a sheet of media from the applicable cassette by lifting the media sheet with rows of suction cups 149A–149C. For the purpose of the following example, assume that a media sheet 144B is selected from cassette 145B for traversing through the platesetter 130. The picker 148 conveys the sheet 144B, via pairs of rollers 180 and 182, to the applicator 162 of the imaging engine 152.

Images are transmitted from the computer system 105 to the RIP 120 which converts the digitized signals received from the microprocessor 108 into raster image signals which are received by the engine controller 150 to control the imaging engine 152. The media picker 148 operates in conjunction with the media handler 142 and the applicator 162 to convey individual sheets of media, e.g., individual plates as shown, from the media handler 142 onto a support or mounting surface 157 of the cylindrical drum 156, as described in patent application Ser. No. 08/915,844 filed Aug. 21, 1997, herein incorporated by reference in its entirety for supplemental background information. Once properly positioned by the applicator 162 on the mounting surface 157, the media 144B is scanned on an emulsion side 273 (shown in FIG. 2) by a scanning light beam 151 radiating from a moving scan assembly 154 in accordance with instructions from the engine controller 150.

After an image has been recorded on a sheet 144B, the sheet is transferred by the applicator 162 via rollers 272 through the redirecting mechanism 200 and through rollers 173 to the media processor 172. The media processor 172 is controlled by the processor controller 170 in accordance with signals received from the microprocessor 108 through the RIP 120. In a preferred embodiment, the media processor 172 includes a chemical processing bath for use with silver based recording media. However, different types of media and processors can be used. After processing, the media is removed from the system 100.

Figure 2:
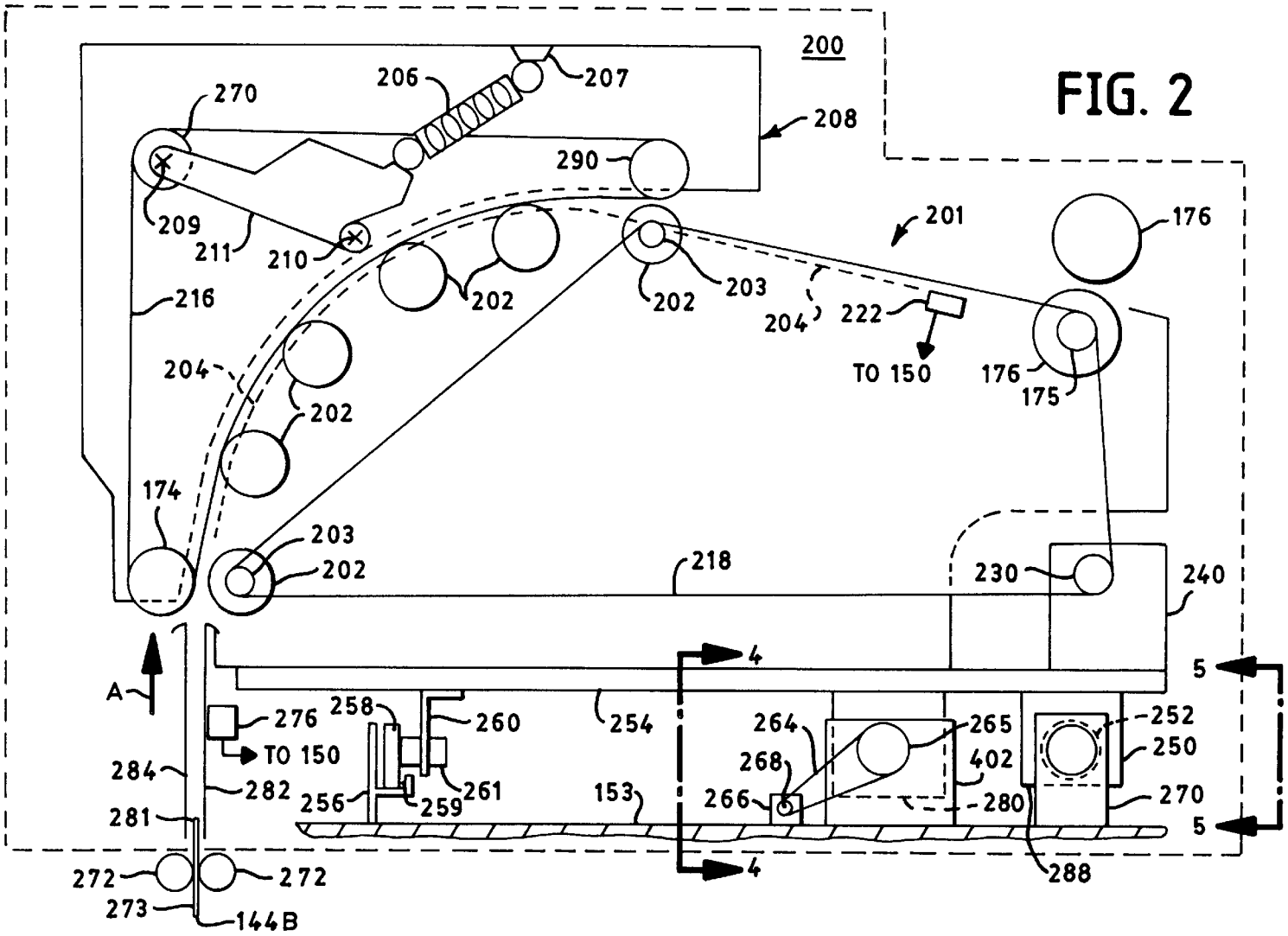
FIG. 2 is a cross sectional cutout view of one preferred embodiment of a redirecting mechanism included in the imaging system of FIG. 1.
Figure 3:
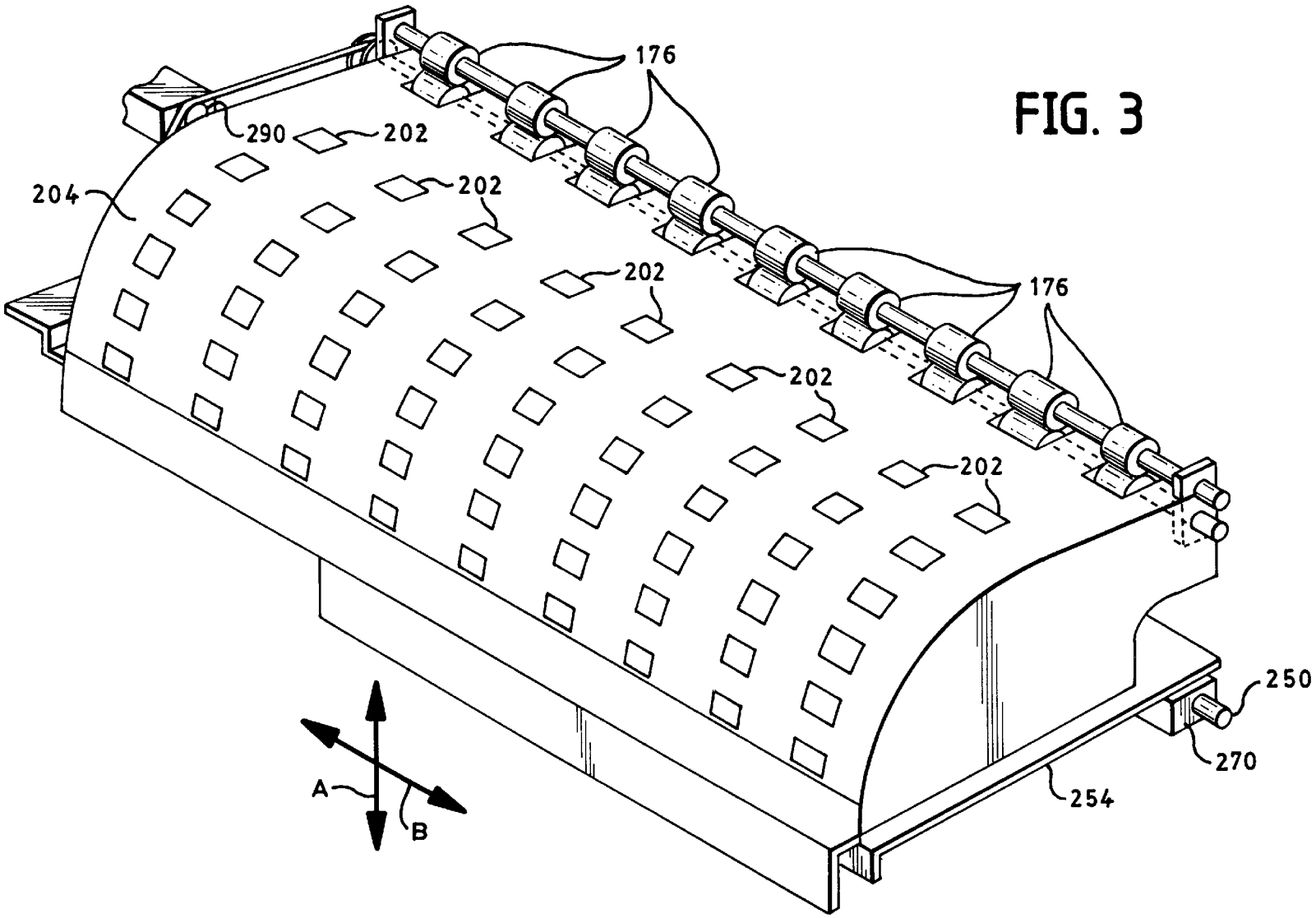
FIG. 3 is a perspective view of the lower assembly of the redirecting mechanism of FIG. 2.

FIG. 2 further details the redirecting mechanism 200, having an upper assembly 208 and a lower assembly 201, which transfers and redirects the sheet 144B from the imaging engine 152 to the media processor 172. Of course, redirection of the media 144B is optional and dependent upon programmed or operator instructions. The applicator 162 directs the leading edge 281 of the imaged sheet of media 144B to output rollers 272, which are controlled by the engine controller 150 to drive the leading edge 281 upward between platens 282 and 284 (see FIG. 2) and hence out of the drum 156. The emulsion side 273 of the media sheet 144B faces platen 284 and belts 216. An output sensing device 276, which preferably includes both a light emitting diode (LED) for directing light onto the imaged sheet of media 144B and a light detector, such as a photodiode, for sensing light reflected by the sheet of media 144B, detects the passage of the leading edge 281 of the media 144B. More particularly, when the leading edge 281 of the media 144B reflects the light emitted by the LED, the detector senses the reflected light causing it to generate an electrical signal to the engine controller 150, thereby informing the engine controller 150 of the presence of the media 144B. The engine controller 150 then directs rollers 272 to continue rotating so that the leading edge 281 of the media 144B is secured between belts 216 and opposing rollers 202 of the lower assembly 201 as shown in FIG. 2. Belt 218 is driven by drive shaft 230 which, in turn, drives rollers 202 via pulleys 203, and drives roller 176 via pulley 175.

The upper assembly 208 (see FIG. 2) of the redirecting mechanism 200 includes rollers 174, 290 and 270 which together rotatably support one or more belts 216. One or more tensioning means or tensioning mechanisms are provided to ensure that each belt 216 is taut between rollers 270, 174 and 290 thereby ensuring contact between the belts 216 and rollers 202 which straddle the interface between the upper and lower assemblies 208 and 201, respectively. The tensioning means each include a bracket 211 which is rotatably moveable about the axis 210, allowing rollers 270 to tension the belts 216 by action of spring 206. Spring 206 is fixedly attached to a base 207 at one end and to the bracket 211 at another end. The tensioning means is provided to each belt 216 to ensure that the media 144B travels along the curved media path of the platen 204. Each of the belts 216, as well as the rollers 174, 270 and 290, are driven by the pulleys 203 and 175 as shown. In this manner a single drive motor 240 is used to power belts 216 and 218 via a drive shaft or pulley 230.

The tensioning means accommodates media of varying thickness and stiffness. The movement of the media 144B is facilitated by the rotation of the pulleys 203 and 175 which are driven by belt 218 via drive shaft 230. The rollers 174, 270 and 290 and the belt(s) 216 of the upper assembly 208 rotate due to the friction between the rollers 202, the media 144B and the belt(s) 216. Thus the belt 218, the rollers 202, the belt 216 and the media 144B move at the same velocity between the upper and lower assemblies. This prevents scuffing of the emulsion side 273 of the media 144B.

After passing by the upper assembly 208, the media 144B travels along and is supported in the lower assembly 201 by platen 204. A second output sensing device 222, similar to sensing device 276, preferably includes both a light emitting diode (LED) for directing light onto the imaged sheet of media 144B and a light detector, such as a photodiode, for sensing light reflected by the sheet of media 144B. The second output sensing device 222 is located adjacent to the platen 204 to detect the passage of the leading edge 281 of the media 144B. More particularly, when the leading edge 281 of the media 144B reflects the light emitted by the LED within the sensing device 222, the detector senses the reflected light causing it to generate an electrical signal to the engine controller 150, thereby informing the engine controller of the location of the media 144B. The engine controller 150 then directs the drive motor 240 to rotate the drive shaft 230 so that the media 144B traverses through roller pairs 174, 202 and 290, 202 along the platen 204 until the leading edge 281 of the media 144B is secured within the nip between rollers 176. The sheet 144B traverses through the passage created between the upper and lower assemblies 208 and 201, respectively.

The region along the platen 204 measured by the linear distance along the media path from the nip located between rollers 174 and 202 to the nip located between rollers 176, is preferably equal to or greater than the length of the media 144B. This region corresponds with the platen 204 and can be referred to as the buffer region 204. With the media in the buffer region 204, the entire redirecting mechanism 200 may be laterally moved to "jog" or redirect the media in a transverse direction B relative to the primary media flow path in the direction A through the imaging engine 152. This motion is particularly beneficial when the sheet 144B is registered within the drum 156 at one end and it is desirable or necessary for the media processor 172 to receive the sheet 144B at a location different from the corresponding location in the drum 156. Thus, the media 144B can be shifted or "jogged" after imaging to facilitate entry into the media processor 172.

To allow movement of the redirecting mechanism 200 relative to the imaging engine 152, the redirecting mechanism 200 is supported by rails 256 and 250. The rail 256 is fixedly attached to the frame 153 of the imaging engine 152, and the rail 250 is attached to support blocks 270 which in turn are fixedly attached to the frame 153. More particularly, two or more L-shaped brackets 260 attached to base 254 support wheels 258 via axles 261, allowing the wheels 258 to roll along a track 259 of the rail 256. Additional brackets and wheels (not shown), spaced substantially far apart along a longitudinal axis of the redirecting mechanism 200, are provided to further support the redirecting mechanism 200.

Figure 5:
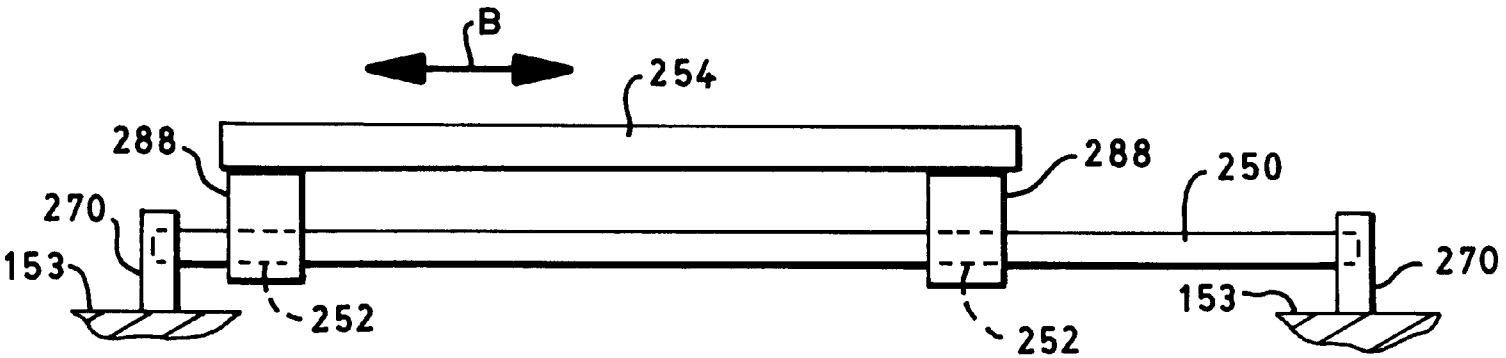
FIG. 5 is a cross sectional view taken along line 5—5 of FIG. 2, illustrating a support mechanism for supporting the redirecting mechanism of FIG. 2.

As shown in FIGS. 2 and 5, a pair of support blocks 270 are provided on either end of rail 250 to secure the rail 250 to the frame 153. A pair of slide blocks 288 which are fixedly attached to the base 254, include slide bearings 252. The slide blocks 288 are preferably spaced wide apart along the longitudinal axis of the redirecting mechanism 200 for engaging the rail 250 via bearings 252, thereby allowing movement of the redirecting mechanism 200 along the rail 250 in the direction B. In the preferred embodiment, the slide bearings 252 are tightly toleranced so that the redirecting mechanism 200 travels substantially perpendicular relative to the primary media flow path A.

Figure 4:
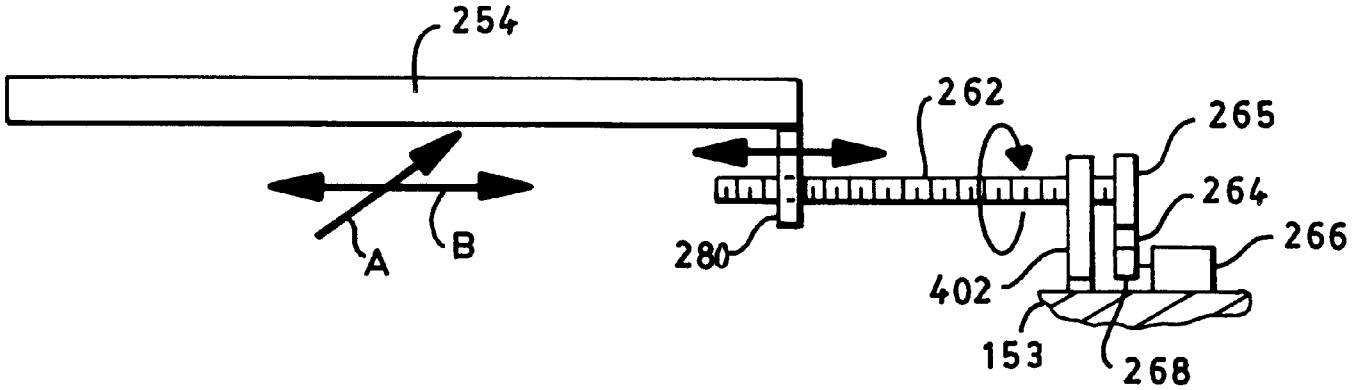
FIG. 4 is a cross sectional view taken along line 4—4 of FIG. 2, illustrating a drive mechanism built for driving the redirecting mechanism of FIG. 2.

As shown more particularly in FIG. 4, drive means is provided to propel the redirecting mechanism 200 along rails 256 and 250. A motor 266 attached to frame 153 of the imaging engine 152 rotates pulley 268 in response to a command from the engine controller 150. Pulley 268 rotates belt 264 which cooperates and rotates pulley 265 attached to one end of a lead screw 262. The lead screw 262 is fixedly supported by a bracket 402, which in turn is attached to the frame 153. The lead screw 262 is threaded through the bracket 280, which is fixedly attached to the base 254. Thus, motor 266 rotates lead screw 262 causing the entire redirecting mechanism 200, which is supported on base 254, to travel in direction B along rails 256 and 250 thereby jogging the buffered media 144B.

It is recognized by those skilled in the art that the redirecting mechanism 200 can be positioned such that the media is jogged before imaging. It is further recognized that although the redirecting mechanism 200 is shown to be an integral part of the imaging engine 152, the mechanism 200 can be a modular unit which attaches separately to the imagine engine 152.

It is also be recognized by those skilled in the art that, while the invention has been described above in terms of one or more preferred embodiments, it is not limited thereto. Various features and aspects of the above described invention may be used individually or jointly. Further, although the invention has been described in the context of its implementation in a particular environment and for particular purposes, those skilled in the art recognize that its usefulness is not limited thereto and the present invention can be beneficially utilized in any number of environments and implementations. Accordingly, the claims set forth below should be construed in view of the full breadth and spirit of the invention as disclosed herein.

What is claimed is:

1. An imagesetting system for recording an image onto a sheet of media, the system comprising:

a transport mechanism for transporting the sheet of media through the imagesetting system in a first direction A;

an imager for recording the image onto the sheet of media; and a jogging mechanism, for redirecting the sheet of media in a transverse direction B relative to the first direction A, comprising an upper assembly and a lower assembly which cooperate (i) to form a passage for the sheet of media, and (ii) to alter direction of media movement while protecting an emulsion surface of the media.

2. The imagesetting system of claim 1, wherein said upper assembly comprises: a plurality of rollers engaging one or more belts; and tensioning means for providing tension onto said belts, said tensioning means facilitating passage of sheets of media having various stiffness and thickness.

3. The imagesetting system of claim 1, wherein said lower assembly comprises: a base; a buffer region for buffering the sheet of media from the imager; means for moving the sheet of media in the first direction A; and means for jointly moving the lower and upper assemblies in said transverse direction B.

4. The imagesetting system of claim 3, wherein said means for jointly moving the lower and upper assemblies in said transverse direction B comprises: a bracket attached to the base of the lower assembly; an axle supported by said bracket; a roller connected to said axle; and a rail attached to the base and including a track, said roller engaging the track to facilitate movement of the lower assembly in said transverse direction B.

5. The imagesetting system of claim 3, wherein said means for jointly moving the lower and upper assemblies in said transverse direction B comprises: a motor mounted onto the frame and including a shaft; a bracket mounted onto the base; a bracket mounted onto the frame; a lead screw engaging both the bracket and the bracket; a pulley fixedly connected to one end of the lead screw; and a belt connected between the shaft and the pulley to facilitate movement of the lower assembly in said transverse direction B in cooperation with the motor.

6. The imagesetting system of claim 3, wherein said means for jointly moving the lower and upper assemblies in said transverse direction B comprises: at least two support blocks mounted to the base; one or more support blocks connected to the base and having bearings therethrough; and a rail engaging said bearings and attached to the at least two support blocks to facilitate movement of the lower assembly in said transverse direction B.

7. A method for operating a platesetting system comprising the steps of:

transporting one or more sheets of media having varying stiffness and thickness through the system in a first direction A;

recording an image onto the sheets; and redirecting the sheets in a transverse direction B relative to the first direction A by first buffering the sheets of media, then moving one or more of the buffered sheets in the transverse direction B.

8. The method of claim 7 wherein the moving step comprises moving an assembly holding the buffered sheets in a transverse direction B by use of a motor driven lead screw engaged between a motor and the assembly.

9. The method of claim 8 wherein the moving step further comprises supporting and guiding the assembly using one or more rails.

* * * * *